United States Patent [19]

Holle

[11] Patent Number: 4,897,595

[45] Date of Patent: Jan. 30, 1990

[54] BAND-GAP REFERENCE VOLTAGE CIRCUIT WITH FEEDBACK TO REDUCE COMMON MODE VOLTAGE

[75] Inventor: Eerke Holle, Eindhoven, Netherlands

[73] Assignee: U.S. Philips Corporation, New York, N.Y.

[21] Appl. No.: 312,505

[22] Filed: Feb. 17, 1989

[30] Foreign Application Priority Data

Feb. 19, 1988 [NL] Netherlands ..... 8800422

[51] Int. Cl.[4] ..... G05F 3/16

[52] U.S. Cl. ..... 323/314; 323/313

[58] Field of Search ..... 323/313, 314, 316

[56] References Cited

U.S. PATENT DOCUMENTS

| | | | |
|---|---|---|---|
| 4,071,813 | 1/1978 | Dobkin | 323/313 |
| 4,249,122 | 2/1981 | Widlar | 323/313 |
| 4,287,439 | 9/1981 | Leuschner | 323/313 |
| 4,317,054 | 2/1982 | Caruso et al. | 323/313 |
| 4,380,706 | 4/1983 | Wrathall | 323/313 |

OTHER PUBLICATIONS

Ye et al.; "Bandgap Voltage Reference Source in CMOS Technology"; Electronics Letters, Jan. 7, '82, vol. 18, No. 1.

*Primary Examiner*—Patrick R. Salce
*Assistant Examiner*—Jeffrey Sterrett
*Attorney, Agent, or Firm*—Bernard Franzblau

[57] ABSTRACT

A relates to a band-gap reference-voltage arrangement includes a MOS differential amplifier (OA2) having two inputs and one output. A first bipolar transistor (Q3) has its base/emitter path coupled between one input of the differential amplifier and a specific junction point and has an emitter-collector path arranged in a first current path for carrying a first current. A second bipolar transistor (Q4) has its base/emitter path connected in series with a resistor (R6) between the other input of the differential amplifier and said junction point and has its emitter-collector path arranged in a second current path for carrying a second current. First and second transistors (P1), P2) supply said first and second currents to the first and second current paths. A feedback path is provided for feeding back the signal from the output of the differential amplifier to the first junction point and comprises a third transistor (Q5) whose base-emitter path is connected between said junction point and the output of the differential amplifier.

10 Claims, 3 Drawing Sheets

BAND-GAP REFERENCE VOLTAGE CIRCUIT WITH FEEDBACK TO REDUCE COMMON MODE VOLTAGE

BACKGROUND OF THE INVENTION

This invention relates to a band-gap reference-voltage arrangement comprising

- a differential amplifier in MOS technology having two inputs and one output,
- a first bipolar transistor whose base-emitter path is arranged between one input of the differential amplifier and a specific junction point and whose emitter-collector path is arranged in a first current path for carrying a first current,
- a second bipolar transistor whose base-emitter path is in series with a resistor and is arranged between the other input of the differential amplifier and said junction point and whose emitter-collector path is arranged in a second current path for carrying a second current,
- a series arrangement of a second and a third resistor connected between a supply voltage terminal and an output terminal for taking off a reference-voltage, the junction point between the second and the third resistor being coupled to the base of the second transistor,
- the output of the differential amplifier being coupled to the output terminal of the arrangment, and
- means for supplying said first and second currents through said first and second current paths.

Such a band-gap reference-voltage arrangement is described, for example, in U.S. Pat. Nos. 4,380,706 and 4,287,439, and in PCT application WO 81/02348. For an explanation of the operation of these known circuit arrangements reference is made to the literature cited and to general articles, such as the article "Band-gap Voltage Reference Sources CMOS Technology", Electronics Letters, 7 Jan., 1982, Vol. 18, no. 1, pages 24/25.

Depending on the specific topology, these known circuit arrangements have one or more of the following drawbacks:

- the common-mode input voltage at the inputs of the MOS differential amplifier is frequently such that the MOS transistors in this amplifier have to operate in their triode region, which may result in an unbalance in the differential amplifier and a loss of gain so that the performance of the entire band-gap reference-voltage arrangement deteriorates,
- the required chip area for the resistors in the arrangement is generally found to be considerable,
- the MOS differential amplifier is afflicted with an offset caused by mismatching of components in the arrangement.

SUMMARY OF THE INVENTION

It is an object of the invention to eliminate these drawbacks, at least partly.

In a band-gap reference-voltage arrangement of the type defined in the opening paragraph, this object is achieved in that the first resistor is arranged between the base of the second transistor and said junction point, which by means of the base-emitter path of a third transistor is coupled to one end of the series arrangement of the second and third resistor. In a circuit arrangement having these characteristic features the voltage difference between the common-mode input voltage of the differential amplifier and the supply voltage on the voltage terminal connected to the series arrangement of the second and the third resistor is larger in comparison with known arrangements. Thus it is avoided that the MOS transistors in the differential amplifier have to operate in their triode regions. The gain factor of the differential amplifier can therefore be high enough to ensure a correct operation of the arrangement. Moreover, in an arrangement having these characteristic features the chip area occupied by the resistors can be recduced substantially.

A first embodiment of a band-gap reference-voltage arrangment in accordance with the invention is characterized in that the base of the third transistor is coupled to the output terminal. In this case the reference-voltage is supplied relative to the positive supply voltage.

A second embodiment of a band-gap reference-voltage arrangement in accordance with the invention may be characterized in that the base of the third transistor is coupled to said supply voltage terminal. This reference-voltage is supplied relative to the negative supply voltage.

A suitable embodiment of the band-gap reference-voltage arrangement in accordance with the invention is characterized in that the first and second transistors are replaced by a first and a second array of transistors, the number of transistors in each array being equal and the transistors in each array being interconnected in such a way that each transistor has its emitter-collector path arranged in a current path for carrying said first and said second current, respectively, and has its base connected to the emitter of the next transistor. The emitter of the last transistor in each array is connected to an input of the differential amplifier, and the base of the first transistor in each array is connected to said junction point and to said resistor, respectively. By replacing the first and the second transistors by an array of transistors, the offset voltage between the inputs of the differential amplifier as a result of the non-identical first and second transistor is reduced.

If a substantial reduction of the offset effect is required it is preferred to include a comparatively large number of transistors in each array. The offset effect decreases as the number of transistors increases. However, the number of transistors in both arrays should not be so large that the voltage across them becomes larger than half the supply voltage, because otherwise the advantage of an improved common-mode setting will diminish.

If the reference-voltage is taken off relative to the positive supply voltage the improvement of the common-mode input voltage of the differential amplifier may be less pronounced, depending on the value of the output voltage, than in the case that both arrays comprise only a single transistor, but on the other hand the influence of the offset caused by mismatching of components is reduced substantially.

A satisfactory compromise can be obtained which enables both an improvement of the common-mode input voltage and an improvement of the offset effect if the number of transistors in each array is two.

BRIEF DESCRIPTION OF THE DRAWING

The invention will now be described in more detail, by way of example, with reference to the accompanying drawings in which.

DESCRIPTION OF THE PREFERRED EMBODIMENTS

Figure 1:
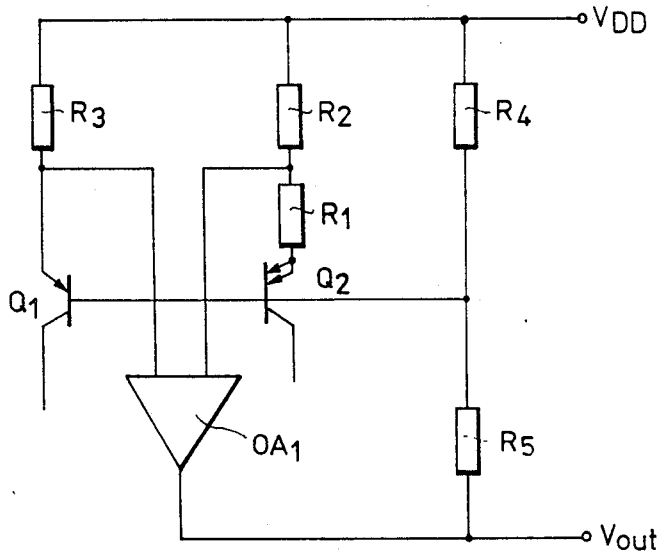
fig-1 PRIOR ART
FIG. 1 is by way of comparison shows an arrangement known per se, in which the MOS transistors of the differential amplifier have to operate in their triode regions and in which in the case of integration a substantial portion of the chip area is occupied by the resistors.

The circuit arrangement shown in FIG. 1 comprises a MOS differential amplifier OA1, the transistors Q1 and Q2 and the resistors R1 to R5. The transistor Q1 is connected to the power supply $V_{DD}$ in series with the resistor R3. The transistor Q2 is connected in series with the resistors R1 and R2 to the power supply $V_{DD}$. The bases of the two transistors Q1 and Q2 are interconnected and are driven by the voltage at the junction point of the series arrangement of the resistors R4 and R5, which is arranged between the power supply $V_{DD}$ and the output terminal on which the output voltage $V_{out}$ is available. The inputs of the differential amplifier are respectively connected to the junction point between Q1 and R3 and the junction point between R1 and R2. The output of the differential amplifier is connected to the output teminal $V_{out}$. The collectors of the two transistors Q1, Q2 are connected to the negative supply voltage, for example, ground, if required via further components, not shown, which may form part of a further circuit utilizing the reference-voltage to be generated. In the simplest case the two collectors are connected directly to the negative supply voltage.

In this circuit arrangement the voltage on the bases of the transistors Q2, Q1 is equal to the positive supply voltage $V_{DD}$ minus the band-gap reference-voltage of approximately 1.3 V. The commonmode input voltage of the differential amplifier OA1 is then equal to $V_{DD}-1.3\ V+V_{BEQ1}\approx V_{DD}-0.7\ V$, which is too high, so that the MOS transistors in the differential amplifier OA1 have to operate in their triode regions. As a result of this the gain of the differential amplifier is comparatively small, which has an adverse effect on the correct operation of the arrangement.

Figure 2:
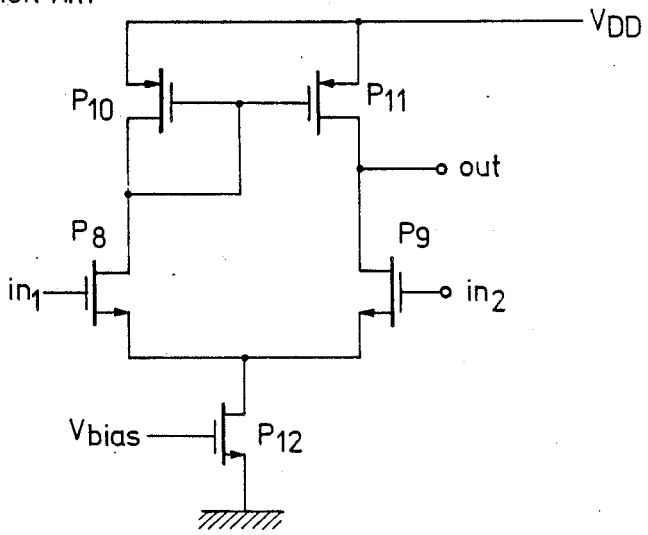
fig-2 PRIOR ART
FIG. 2 shows diagrammatically the principal components of the differential amplifier.

FIG. 2 shows diagrammatically the principal components of the differential amplifier, i.e. the MOS transistors P8 to P11. The two transistors P10 and P11 constitute a current mirror for supplying currents to the input transistors P8 and P9, which are connected to the two inputs IN1 and IN2. The transistors P12 provides the current setting and is controlled by the bias voltage $V_{bias}$. The output signal is then available on the output terminal out. For further details of such a MOS differential amplifier, reference is made to the literature well-known to those skilled in the art. By way of example, reference is made to the article "An integrated Single Chip PCM Voice codec with filters", IEEE Journal of Solid State Circuits, Vol. Se-16, L no. 4, Aug. 1981, page 330, FIG. 13.

Figure 3:
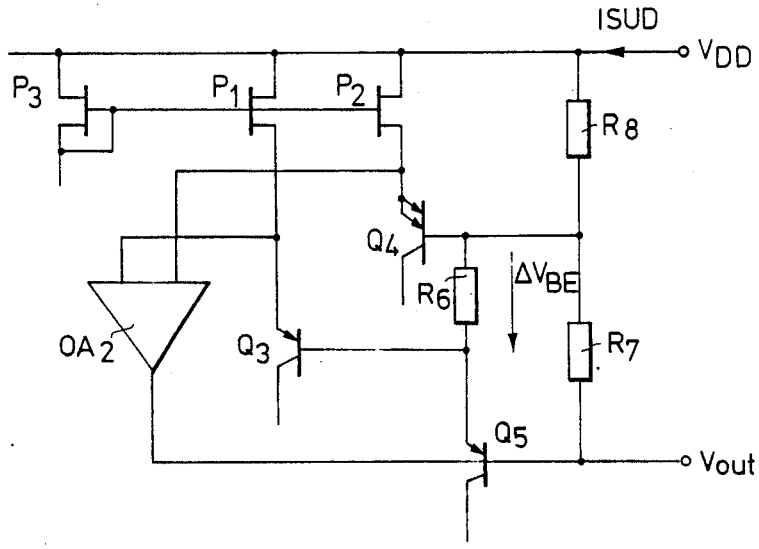
FIG. 3 shows a first embodiment of an arrangement in accordance with the invention.

FIG. 3 shows a first embodiment of a circuit arrangement in accordance with the invention in which the common-mode input voltage of the differential amplifier is at a lower voltage level relative to the positive supply voltage $V_{DD}$ than in the arrangement shown in FIG. 1. This arrangement again comprises the MOS differential amplifier OA2, the bipolar transistors Q3, Q4, Q5, the resistors R6, R7, R8, and the MOS transistors P1, P2 and P3. The transistors P1 and P2 together with the current source transistor P3 are arranged in a current mirror circuit and are connected to the power supply voltage $V_{DD}$. Further, the transistors P1, P2 and P3 are dimensioned in such a way that for a predetermined current through P3 a desired first current flows through P1 and a desired second current through P2. P1 is arranged in series with Q3 so that the first current also flows through Q3, and P2 is arranged in series with Q4 so that the second current also flows through Q4. The junction point between P1 and Q3 is connected to one input of the differential amplifier OA2 and the junction point between P2 and Q4 is connected to the other input of the differential amplifier OA2. The bases of the transistors Q3 and Q4 are each connected to a terminal of the resistor R6. Moreover, the base of Q3 is connected to the emitter of Q5, whose base is driven by the output of the differential amplifier OA2. The base of Q5 is further connected to the resistor R7, which is arranged in series with the resistor R8 between the power supply $V_{DD}$ and the output junction point on which the output voltage $V_{out}$ is available. The junction point between R7 and R8 is connected to the base of Q4. The collectors of the transistors Q3, Q4, Q5 are connected to the negative supply voltage (for example, ground) either directly of via components of the circuit of which the reference arrangement forms a part.

The currents through the transistors Q3 and Q4 and the appropriate dimensioning of Q4 ensure that different base emitter voltages $\Delta V_{BE}$ are produced across the two transistors. The difference between the two base-emitter voltages $\Delta V_{BE}$ appears across the resistor R6. By driving the transistors Q5 the operational amplifier OA2 tends to influence the current through R6 in such a way that a balanced situation is obtained in which the arrangement, in a manner known per se, can function as a band-gap reference-voltage arrangement. However, the difference with respect to the known arrangement resides in the fact that in the present arrangement the common-mode input voltage appears on the inputs of the differential amplifier OA2. As will be apparent from FIG. 3, the common-mode input voltage $V_{cm}$ for a choice of $V_{out}=2.8$ V, which is determined by the resistance value of the resistors R7 and R8, will be equal to $$\begin{aligned} V_{cm} &= V_{DD} - V_{out} + V_{BE}(Q5) + V_{BE}(Q3) \\ &= V_{DD} - 2.8\ V + 0.6\ V + 0.6\ V \\ &= V_{DD} - 1.6\ V \end{aligned}$$

The above numerical example shows that the common-mode input voltage of the differential amplifier in the arrangement shown in FIG. 3, in comparison with the situation in FIG. 1, is reduced substantially relative to the positive supply voltage $V_{DD}$.

An additional though not insignificant advantage is that the overall resistance in the arrangement shown in FIG. 3 is reduced considerably. For the same power supply current of 12.2 μA as in FIGS. 1 and 2, the overall resistance required in the arrangement as shown in FIG. 3 is only 46% of the overall resistance in the arrangement shown in FIG. 1. This results in a corresponding reduction in chip area.

Figure 4:
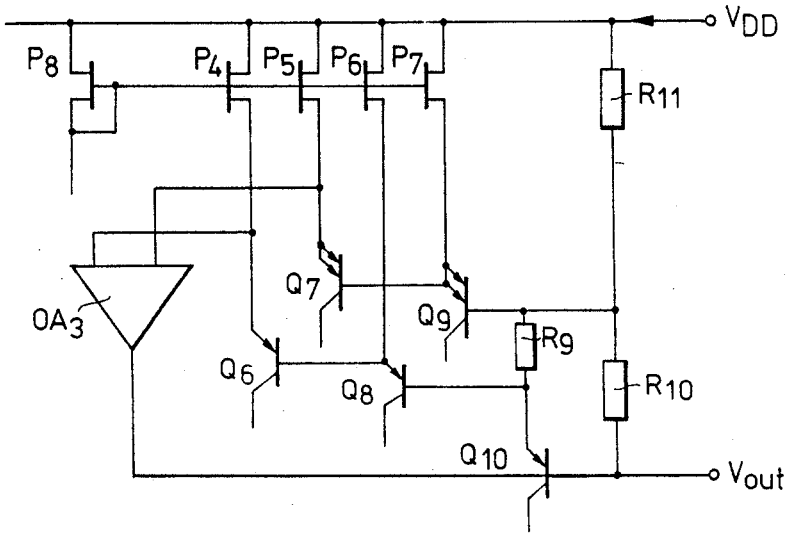
FIG. 4 shows an embodiment of an arrangement as shown in FIG. 3, employing two arrays comprising two transistors each.

FIG. 4 shows a second embodiment of an arrangement in accordance with the invention, which instead of the transistors Q3 and Q4 employs a cascade arrangement comprising the transistors Q6 and Q8 and Q7 and Q9, respectively. Each of said transistors Q6 to Q9 is connected to the power supply line $V_{DD}$ in series with a separate MOS transistor P4 to P7. The MOS transistors P4 to P7 are arranged as a current mirror circuit controlled by the current source transistor P8 in such a way that a first current flows through each of the transistors Q6 and Q8 and a second current flows through each of the transistors Q7 and Q9. For the remainder the arrangement shown in FIG. 4 is identical to that of FIG. 3, except that the resistors R9, R10 and R11 perform the functions of the resistors R6, R7 and R8 in FIG. 3, the transistor Q10 performs the same function as the transistor Q5 in FIG. 3, and the differential amplifier OA3 performs the same function as OA2 in FIG. 3. In FIG. 4 the connections between the collectors of the transistors Q6 . . . Q10 and a fixed potential are not indicated.

For the same voltage $V_{out}=2.8$ V across the resistors R10 and R11, the common-mode input voltage $V_{cm}$ of the differential amplifier OA3 will now be equal to $$\begin{aligned} V_{cm} &= V_{DD} - V_{out} + V_{BE}(Q10) + V_{BE}(Q8) + V_{BE}(Q6) \\ &= V_{DD} - 2.8\ V + 0.6\ V + 0.6\ V + 0.6\ V \\ &= V_{DD} - 1.0\ V \end{aligned}$$

In comparison with the situation in FIG. 1 the common-mode input voltage is still reduced relative to the voltage $V_{DD}$, although this reduction is smaller than achieved with the embodiment shown in FIG. 3. However, the effect of a possible offset in the differential amplifier, caused by mismatching of components, is now reduced by a factor of 2. In this respect it is to be noted that now a voltage $2\Delta V_{BE}$ is developed across the resistor R9, i.e. a base-emitter differential voltage which is twice as large as the comparable voltage across the resistor R6 in FIG. 3.

A further reduction of the effect of offset can be achieved by using three or more transistors in each of the cascade arrangements. It will be evident that, depending on the magnitude of the voltage across the resistors R10 and R11, this will be at the expense of the improvement in common-mode input voltage. However, under specific circumstances it may be preferred to utilize cascade circuits comprising larger numbers of transistors.

Figure 5:
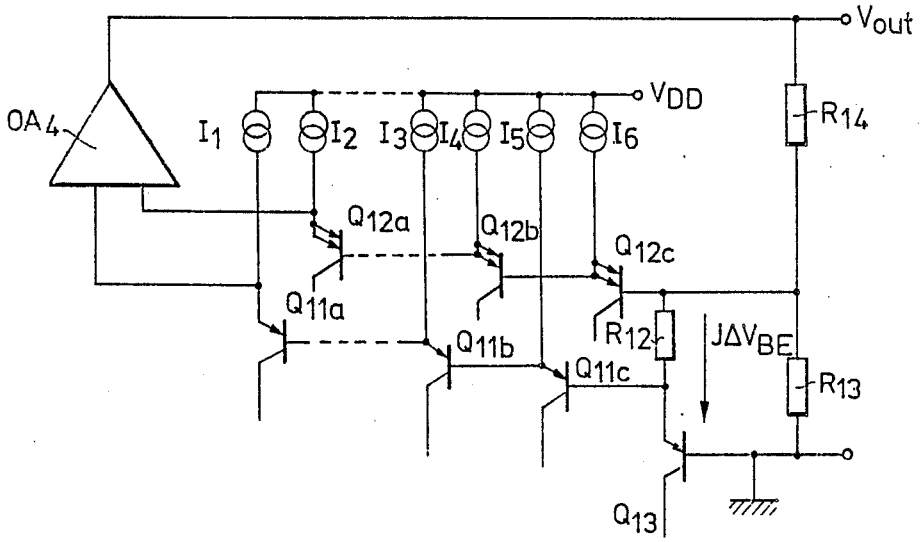
FIG. 5 shows a second embodiment of the arrangement in accordance with the invention which also utilizes transistor arrays.

FIG. 5 shows a second embodiment of an arrangement in accordance with the invention, comprising a cascade circuit comprising j transistors. In this embodiment the base of the transistor Q13 is connected to the negative supply voltage, in the present example, ground, and the output of the diffenrential amplifier OA4 is connected to the output terminal. Now this results in the generation of a positive reference-voltage $V_{out}$ relative to ground.

The arrangement shown in FIG. 5 comprises said differential amplifier OA4, the transistors Q11*a* . . . Q11*c* constituting the first array, the transistors Q12*a* . . . Q12*c* constituting the second array, and the transistor Q13. The arrangement further comprises the resistors R12, R13 and R14, which perform the same functions as the resistors R9, R10, R11 in FIG. 4. The MOS transistors, which are operated as current source transistors, are not shown separately but are represented diagrammatically as the current sources I1 to I6. Again, the further connections between the collectors of the bipolar transistors Q11*a* . . . Q11*c*, Q12*a* . . . Q12*c*, Q13 to a negative supply voltage are not shown.

If each casade circuit comprises J transistors a voltage $j\Delta V_{BE}$ will be generated across the resistor R12.

The output voltage $V_{out}$ of the arrangment can be computed as follows $$V_{out}=g\,[V_{BE}(Q13)+n.j.\Delta V_{BE}+n.V_{os}]$$

where $g=1+R14/R13$ $n=1+(1/g).(R14/R12)$ $V_{BE}$=basis-emitter voltage $V_{os}$=equivalent input offset voltage of OA4 j=an arbitrary integer, representing the number of transistors in each array.

Suitably, j is selected to be as large as possible within the limits imposed by the value of the power-supply voltage $V_{DD}$. If allowance is made for the base-emitter voltage across Q13, the following relationship is valid $$(j+1)\cdot V_{BE}<V_{DD}-(\text{voltage drop across the current sources } I_n)$$

in practice, j=4 will be a satisfactory choice for a power supply voltage $V_{DD}=4.5$ V.

The output voltage $V_{out}$ becomes temperature-independent for $T_O$ if R14/R13 is selected in such a way that $$n=[1.2\ V-V_{BE}(Q13)]/[j\cdot\Delta V_{BE}]T_O$$

If j is selected to be as large as possible the effect of $V_{os}$ is reduced.

It is to be noted that in this embodiment, in contrast to the embodiment shown in FIG. 4, where the level of the common-mode input voltage relative to the positive supply voltage is adversely affected by replacing the first and second transistor by the two arrays, this replacement has a favourable influence on said relative level. It is obvious that in the embodiment shown in FIG. 5 the arrangment may be constructed by means of separate transistors instead of arrays.

Further, it is to be noted that in the embodiments shown herein the differential amplifier may be of a different construction than that shown in FIG. 2.

Finally, it is to be noted that in the embodiments shown herein the transistors may be replaced by transistors of the opposite conductivity type.

I claim:

1. A band-gap reference-voltage arrangement comprising:

an MOS differential amplifier having two inputs and one output, a first bipolar transistor whose base-emitter path is connected between one input of the differential amplifier and a first junction point and whose emitter-collector path is connected in a first current path for carrying a first current, a second bipolar transistor whose base-emitter path is connected in series with a resistor between the other input of the differential amplifier and said first junction point and whose emitter-collector path is connected in a second current path for carrying a second current, a series arrangement of a second and a third resistor coupled between a supply voltage terminal and an output terminal for taking off a reference-voltage, a second junction point between the second and the third resistor being coupled to the base of the second transistor, the output of the differential amplifier being coupled to said output terminal of the arrangement, means for supplying said first and second currents to said first and second current paths, characterized in that the first resistor is coupled between the base of the second transistor and said first junction point, which by means of the base-emitter path of a third transistor is coupled to one end of the series arrangement of the second and third resistor.

2. A band-gap reference-voltage arrangement as claimed in claim 1, characterized in that the base of the third transistor is coupled to the output terminal.

3. A band-gap reference-voltage arrangement as claimed in claim 1, characterized in that the base of the third transistor is coupled to said supply voltage terminal.

4. A band-gap reference-voltage arrangement as claimed in claim 3, characterized in that the first and second transistors are replaced by a first and a second array of transistors, respectively, the number of transistors in each array being equal and the transistors in each array being interconnected such that each transistor has its emitter-collector path connected in a current path carrying its respective said first and said second current, and has its base connected to an emitter of a next transistor, the emitter of the last transistor in each array being connected to a respective input of the differential amplifier, and the base of the first transistor in said first and second arrays being connected to said first junction point and to the first resistor, respectively.

5. A band-gap reference-voltage arrangement as claimed in claim 4, characterized in that the number of transistors in each array is two.

6. A band-gap reference-voltage arrangement as claimed in claim 1, characterized in that the first and second transistors are replaced by a first and a second array of transistors, respectively, the number of transistors in each array being equal and the transistors in each array being interconnected such that each transistor has its emitter-collector path connected in a current path carrying its respective said first and said second current, and has its base connected to an emitter of a next transistor, the emitter of the last transistor in each array being connected to a respective input of the differential amplifier, and the base of the first transistor in said first and second arrays being connected to said first junction point and to the first resistor, respectively.

7. A band-gap reference-voltage arrangement as claimed in claim 6, characterized in that the base of the third transistor is coupled to the output terminal.

8. A band-gap reference-voltage arrangement as claimed in claim 1 wherein said means for supplying said first and second currents comprise a current mirror circuit having an input branch including a semiconductor diode and first and second output branches comprising first and second transistors, respectively, coupled to said first and second current paths, respectively.

9. A band-gap reference-voltage arrangement as claimed in claim 1 wherein said first resisftor is connected directly to the base of the second transistor and said first junction point is connected directly to the base of the first transistor.

10. A band-gap reference-voltage arrangement as claimed in claim 1 wherein said first resistor is connected directly between said first and second junction points.

* * * * *